US005201438A

United States Patent [19]

Norwood

[11] Patent Number: 5,201,438

[45] Date of Patent: Apr. 13, 1993

[54] COLLAPSIBLE FACETED CONTAINER

[76] Inventor: Peter M. Norwood, 600 Plaza Middlesex, Middletown, Conn. 06457

[21] Appl. No.: 885,869

[22] Filed: May 20, 1992

[51] Int. Cl.[5] ..... B65D 1/40

[52] U.S. Cl. ..... 220/666; 215/1 C; 215/11.13

[58] Field of Search ..... 215/1 C, 11.3; 220/666, 220/675, 672, 670, 669, 6; 138/119, 121; 222/215, 107, 105, 95, 92

[56] References Cited

U.S. PATENT DOCUMENTS

| | | | |
|---|---|---|---|
| Re. 32,379 | 3/1987 | Touzani | 215/1 C |
| 3,872,994 | 3/1975 | Hyde | 215/1 C |
| 4,125,130 | 11/1978 | Yamamoto | 138/121 |
| 4,773,458 | 9/1988 | Touzani | 215/1 C |
| 4,775,564 | 10/1988 | Shriver et al. | 215/1 C |
| 4,790,361 | 12/1988 | Jones et al. | 215/1 C |
| 4,865,211 | 9/1989 | Hollingsworth | 215/1 C |
| 4,873,100 | 10/1989 | Dirksing et al. | 215/1 C |
| 5,002,193 | 3/1991 | Touzani | 215/100 A |
| 5,100,017 | 3/1992 | Ishinabe | 220/669 |

FOREIGN PATENT DOCUMENTS

| | | | |
|---|---|---|---|
| 1432253 | 11/1968 | Fed. Rep. of Germany | 215/1 C |
| 2316132 | 1/1977 | France | 220/907 |

*Primary Examiner*—Allan N. Shoap
*Assistant Examiner*—S. Castellano
*Attorney, Agent, or Firm*—C. G. Nessler

[57] ABSTRACT

A multi-faceted collapsible container has a sidewall of joined-together rings comprised of pyramidal segments having peaks extending outwardly. Each segment is comprised of four polygonal facets; the upper pair of facets is longer than the lower pair. Sufficient vertical force causes the smaller lower facets to fold under the longer upper facets, collapsing the rings and the sidewall of the container.

6 Claims, 4 Drawing Sheets

Fig. 6
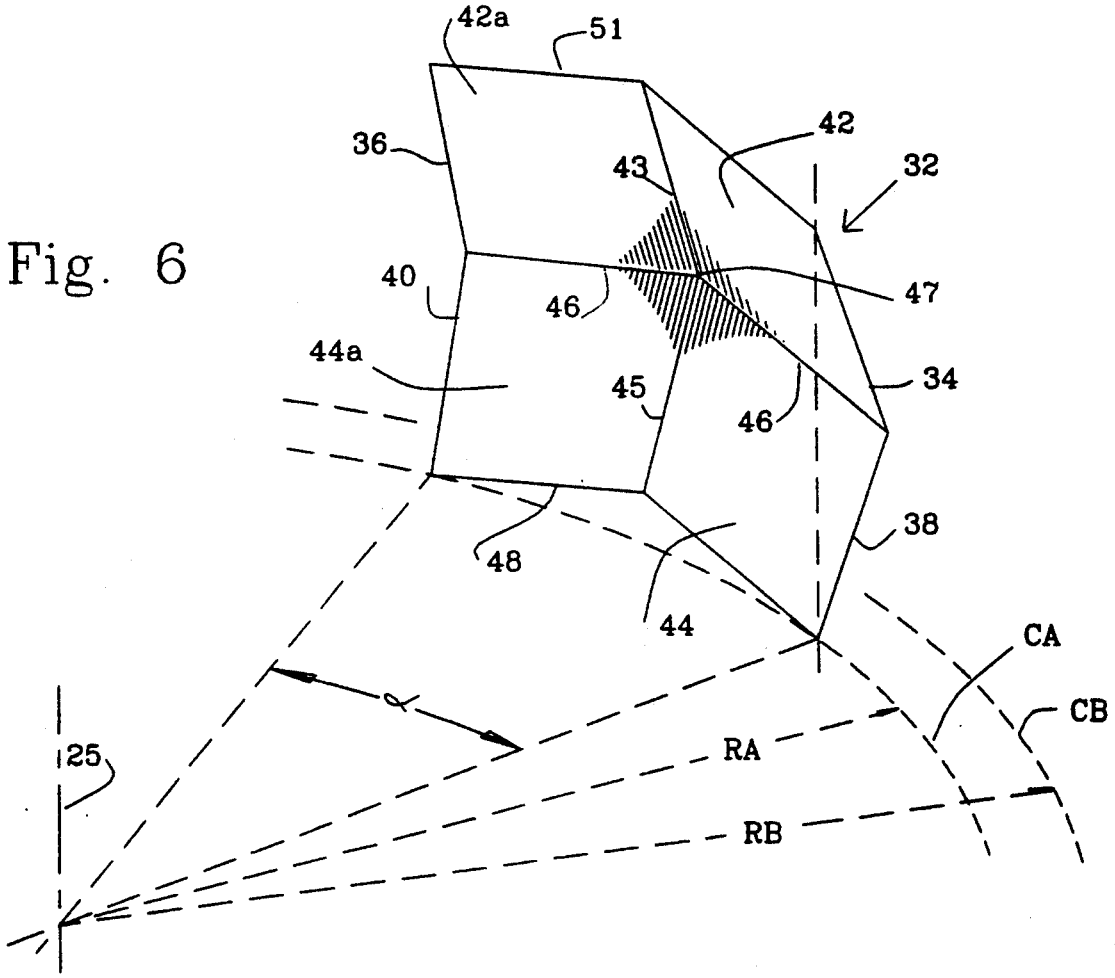
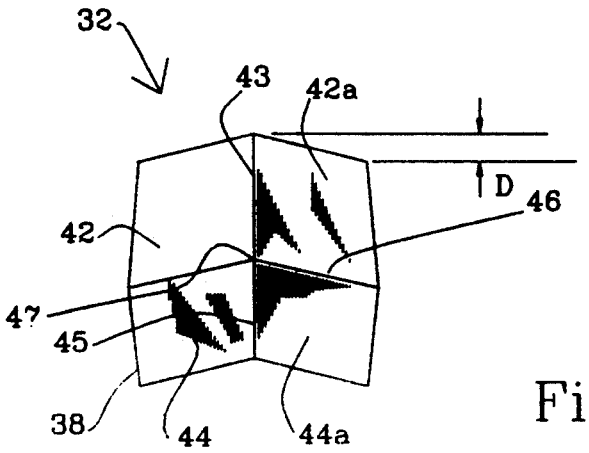
Fig. 5

COLLAPSIBLE FACETED CONTAINER

FIELD OF THE INVENTION

The present invention relates to collapsible containers particular to plastic bottles for containing solid and liquid things.

Collapsible containers, such as tubes and bottles, made of plastic and metal, are known. When configured as tubes, they are used for accommodating changing positions between objects, such as when a bellows connects two machine parts. When configured as bottles or cans, they are useful for containing beverages and for other purposes to which sealed containers are put.

A typical collapsible container contracts along its axial length. In beverage bottles, this will be either when partially or fully emptied. Thus, such bottles can be sized to the remaining contents, or after use they can be fully collapsed.

Lately, there has been much public attention to the problem of waste disposal, and of recycling of metal and plastic bottles and cans, in particular. Although light in weight, empty containers increase the volume of refuse. Bottles, cans, and other containers which can readily collapse will reduce volume, and thus reduce the cost for collecting and disposing of such things.

Certain patents reflect prior attempts at providing a technically and economically suitable product. U.S. Pat. No. 4,775,564 to Shriver et al. shows a collapsible container having a sidewall with a number of pleats or flutes, like a bellows. U.S. Pat. No. 4,873,100 to Dirksing et al. shows a somewhat similar appearing container, where the successive vertical rings of the container become smaller, thus facilitating the collapse. U.S. Pat. No. 4,865,211 to Hollingsworth describes a collapsible container wherein a smaller diameter base slips inside the larger diameter upper part when axial force is applied. U.S. Pat. No. 5,002,193 to Touzani shows another bellows-like container, where each peak corrugation folds at its outer edge when the collapsing force is applied. U.S. Pat. No. 4,492,313 to Touzani shows another container where each corrugation folds at its outermost peak, and where collapsing is aided by folds in the valley corrugations. U.S. Pat. No. 4,805,788 to Akiho shows a bottle with collapsible sidewall panels. U.S. Pat. No. 4,492,313 to Touzani shows a circular bellows-like sidewall, where the bottom portion of each ring folds under the upper portion when the container is collapsed. U.S. Pat No. 4,790,361 to Jones et al. describes a bottle having corrugations comprised of a multiplicity of polygonal planes.

The prior art indicates that a lot of effort has been applied to making collapsible containers. Still, there is continuing need for improvements in the design and manner of collapse, to provide containers which are dimensionally stable and strong when filled and which are readily collapsible to compact stable shapes.

SUMMARY OF THE INVENTION

An object of the invention is to provide containers which are strong and stable, but which readily fold to compact stable shapes when emptied, to reduce the volume of empty containers.

In accord with the invention, a cylindrical container has a collapsible sidewall comprised of two or more rings joined together axially at zig-zag fold lines. Each ring is comprised of a multiplicity of pyramidal segments joined each to the other at vertical fold lines; the apexes of the pyramid face outwardly from the sidewall of the container. Each segment is comprised of an upper pair of facets and a smaller lower pair of facets, the pairs joined at a zig-zag generally horizontal fold line. The nominal circumference of the pair-joining fold lines is greater than the nominal circumference of the ring-joining fold lines. The horizontal fold lines are bent upwardly at the center of each segment. Thus, when axial force is applied to the container, there is deformation wherein the lower pairs of facets in a ring fold under the upper pair of segments, and each ring collapses on itself, thereby causing the sidewall to collapse.

In preferred articles, the container has either an open top and bottom or a combination of open and closed top and bottom. Preferably, the article is made from common plastic, but it can be made of metals and composites as well.

The container is made by plastic molding, as ordinarily is used for plastic bottles. When the sidewall is comprised of a number of rings, a substantial change in vertical height occurs, thus fulfilling the objects of the invention. The foregoing and other objects, features and advantages of the invention will become more apparent from the following description of the best mode of the invention and accompanying drawings.

BRIEF DESCRIPTION OF THE DRAWING

FIG. 5 shows in exterior side view a pyramidal sidewall segment of which the collapsible rings are comprised, viewed from slightly below the horizontal plane of the ring in which the segment lies.

FIG. 6 shows in isometeric view a pyramidal sidewall segment and how its facets are geometrically related to each other and the container circumference and center.

DESCRIPTION OF THE PREFERRED EMBODIMENT

Figure 1:
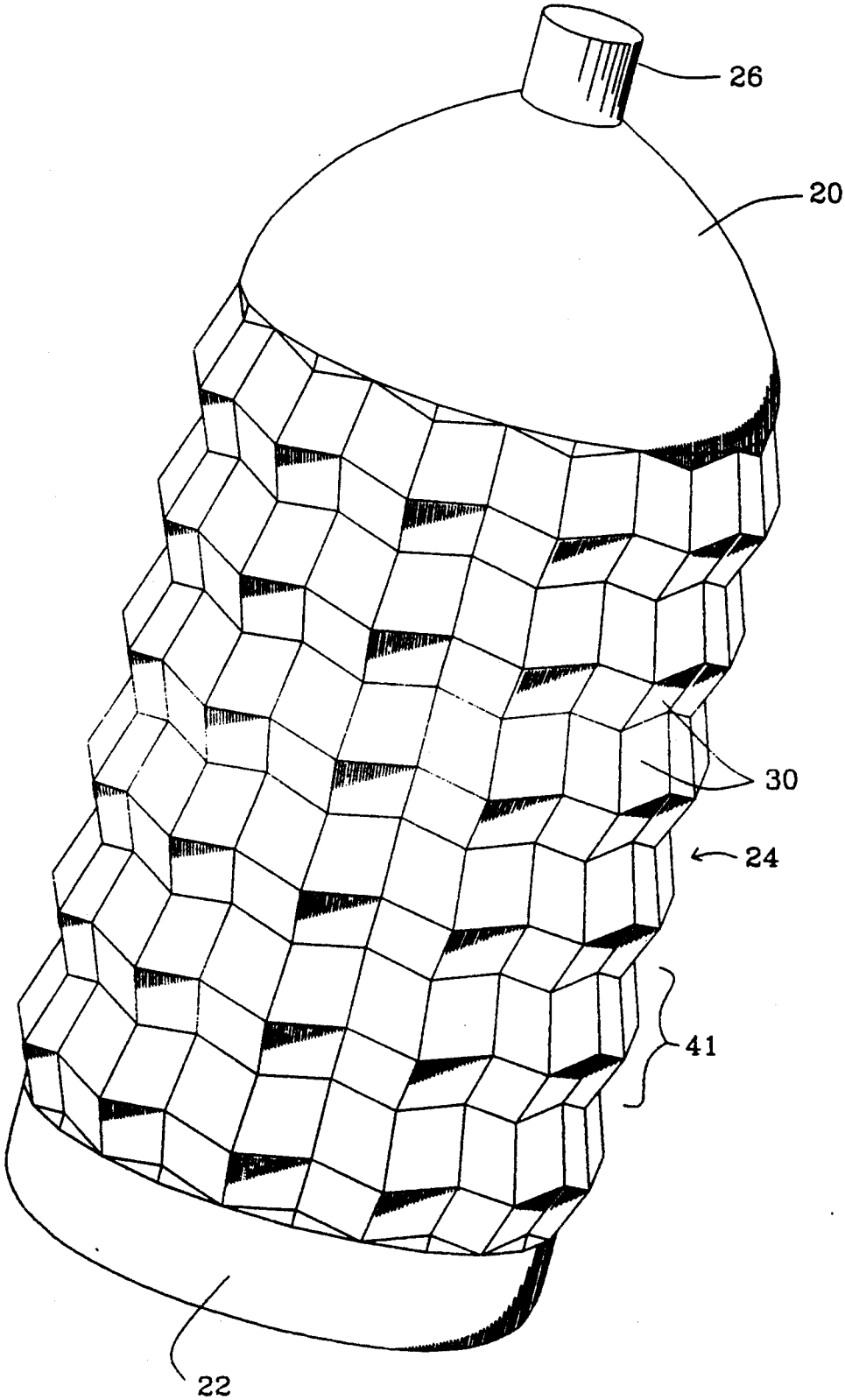
FIG. 1 is an axiometric view of a bottle ready for being filled with contents, showing how the collapsible faceted side wall is comprised of a series of stacked together rings.
Figure 2:
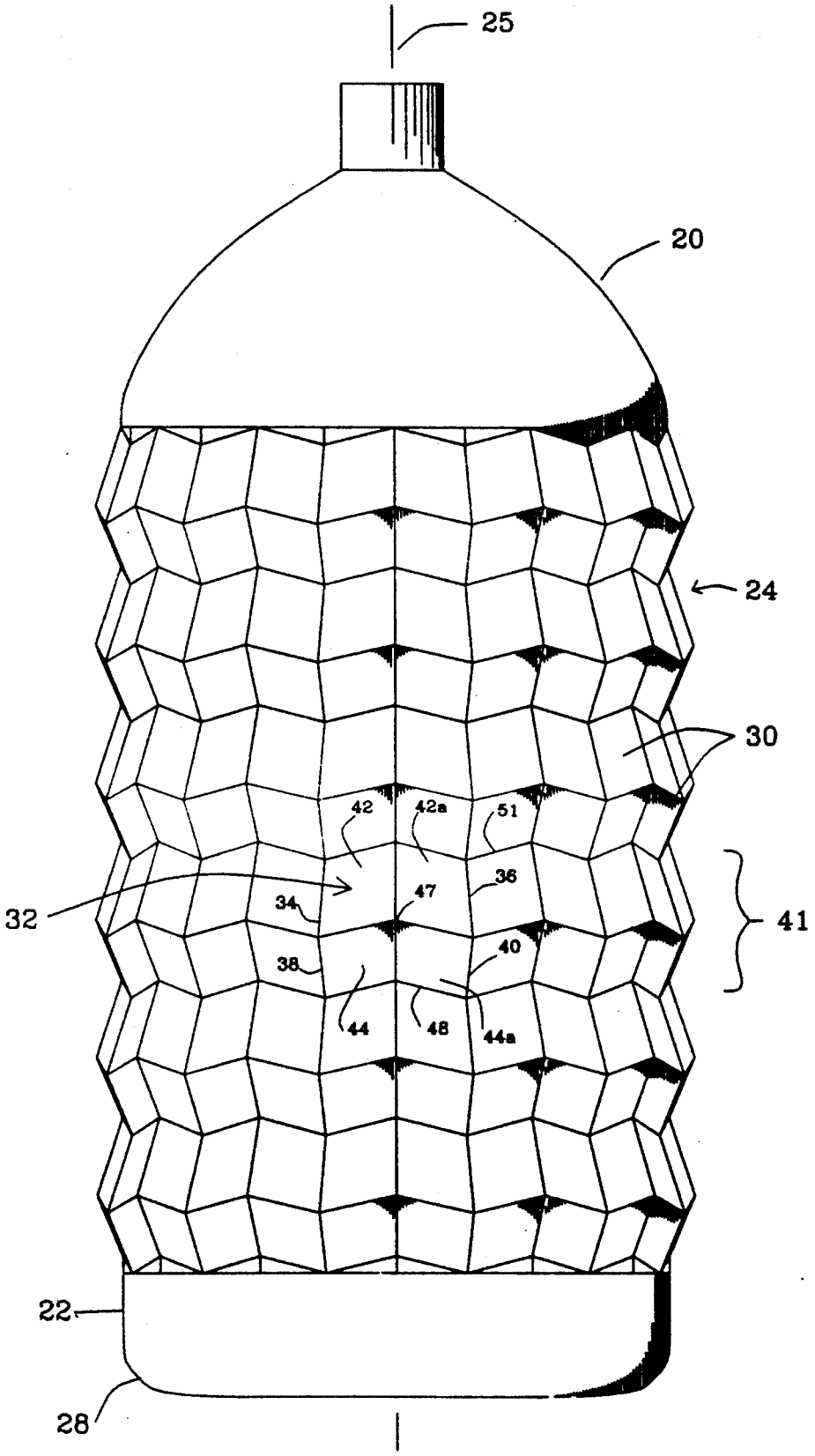
FIG. 2 is a side view of the bottle of FIG. 1 showing the zig-zag nature of the generally horizontal fold lines and the alignment of the vertical fold lines.

The preferred embodiment is described in terms of a molded plastic bottle. FIG. 1 and 2 show a bottle having a top 20 and spaced apart bottom 22, connected by a generally cylindrical faceted sidewall 24, lying along a longtitudinal axis 25. The top has a neck 26, suitable for a closure. The bottom is cylindrical with a curved edge 28 and may be concave for strength.

The sidewall is comprised of a multiplicity of rings 42,41 connected to each other at a generally horizontal zig-zag fold lines 48,51. The rings are comprised of a multiplicity of panels or facets 30. The facets are arranged in groups of four, to form pyramidal segments. For example, four facets form a segment 32 which in FIG. 5 is shown removed from the container sidewall.

As illustrated for typical segment 32, in FIG. 2, the segments are connected to each other circumferentially at vertical ring fold lines 34, 38, 36, 40 to form rings 41. In FIGS. 1 and 2 it is seen that 12 segments make up each of the six rings. The apex 47 of the pyramidal segment faces outwardly from the periphery of the ring.

Typical segment 32 is comprised of four polygonal facets, as shown in in FIG. 5, a view from slightly below the horizontal of the ring 41 in which the segment lies. FIG. 6 shows a typical segment from the opposite side, i.e., looking from the interior of the container, and shows its geometric relation with the rest of the container. A segment has two upper facets 42, 42*a* joined at vertical fold line 43 and two lower facets 44, 44*a*, joined at vertical fold line 45, all the facets forming a pyramid having a peak 47. The vertical segment fold lines are aligned with each other and lie in a vertical plane along with the longtitudinal axis of the container. The plane of the vertical fold lines 43,45 is mid-way between the vertical planes of the vertical ring fold lines 34,38,36,40 on either side of the segment. Each facet of the upper pair is longer than each facet in the lower pair, as such lengths are measured along the vertical fold lines. Each upper facet 42, 42*a* is attached to the corresponding lower facet 44, 44*a* along a zig zag generally horizontal ring fold line 46. Each upper facet is more nearly vertical than each lower facet.

The zig-zag generally horizontal ring fold lines 48, 51 at the top and bottom of the segment, where adjoining rings 41 connect, are upward-bent (or "laterally displaced", in my jargon) a distance D where they intersect the vertical fold lines 43,45 of the segment. Similarly, the generally horizontal fold line 46, running between the upper and lower facet pairs and through the center of the segment, is also zig-zag and bent upwardly at the vertical segment fold line.

FIG. 6 further details the complex geometry of the segment. It is seen that the horizontal fold lines 51,48 at the top and bottom of the segment, where adjacent rings meet, lie generally along a first nominal circumference CA having a first radius RA, while the segment horizontal fold line 46 that goes through the midpoint or peak of the pyramidal segment lies generally along a second nominal circumference CB having a second radius RB which is greater than first radius RA.

Figure 3:
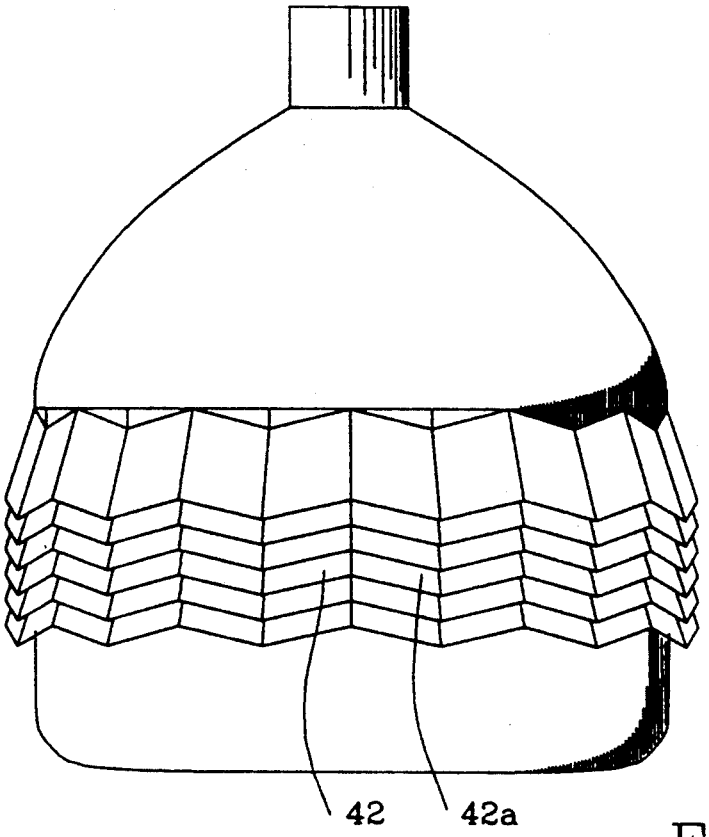
FIG. 3 is a side view of the bottle of FIG. 1 in the collapsed state.
Figure 4:
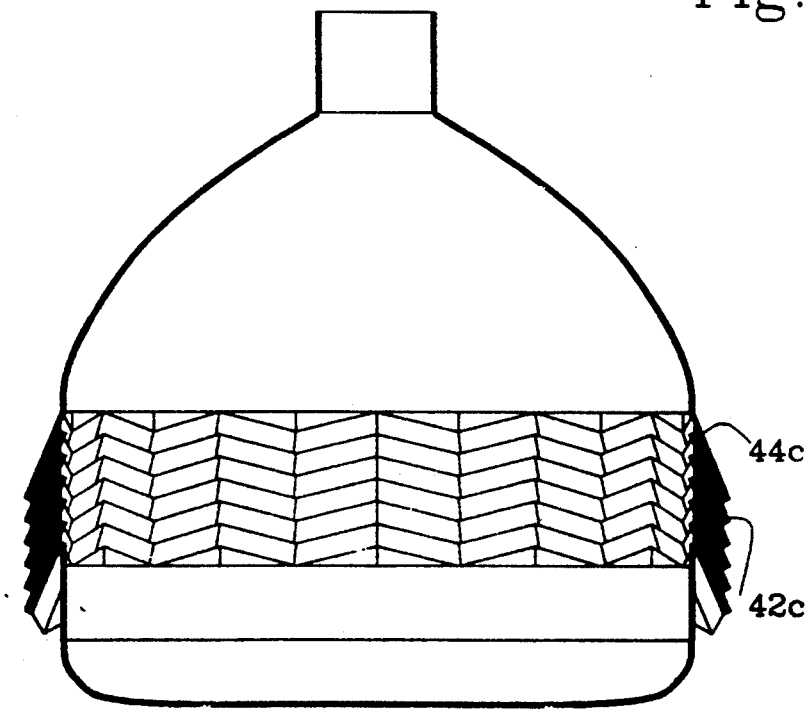
FIG. 4 is a centerline cross section of the collapsed bottle of FIG. 3 showing how lower facets of each ring have folded under the upper facets.

FIG. 3 is a side view of the container after it has been collapsed by the application of vertical force. Only the upper facets 42, 42*a* of the segment 32 are visible, the lower segments having folded underneath them. This collapse of rings is further detailed by the vertical plane cross section of FIG. 4, showing how a typical upper facet 44*c* overlies the folded-under lower facet 42*c*.

As illustrated by FIG. 6, a segment lies along a certain arc angle of the circumference, i.e., for the 12 segment bottle, each segment will lie along 30 degrees of circumferential arc. The number of segments which make up a ring can be changed. For example, 4 or 6 segments or multiples thereof may be used. When there are n segments, each segment will lie along 360/n degrees of arc.

Of course, within the scope of the invention, the facet overhang (difference between the first and second circumferences) can be changed. The shape and size of the facets will reflect choice of container diameter, number of segments and facet overhang.

For different uses, the container may have different combinations of top and bottom. For example, the top can bottom can be open, or they can be both closed. The container can of course be made of materials other than plastic, including aluminum, steel, and composites.

Although only the preferred embodiment has been described with some alternatives, it will be understood that further changes in form and detail may be made without departing from the spirit and scope of the claimed invention.

What is claimed is:

1. A container comprising a top and a bottom, spaced apart along a longitudinal axis, connected by a multifaceted generally cylindrical sidewall comprised of:

a plurality of axially stacked rings comprises of a multiplicity of pyramidal segment, adjacent rings joined each to the other at zig-zag generally horizontal ring fold lines having a first nominal circumference, to form a collapsible portion of the cylindrical sidewall; adjacent pyramidal segment sin each ring joined to each other at generally vertical ring fold lines lying in vertical planes containing the longitudinal axis;

each pyramidal segment having an apex, the apex projecting upwardly and outwardly from the periphery of the ring;

each pyramidal segment comprised of two upper facets joined at a first vertical segment fold line and two lower facets joined at a second vertical segment fold line, the pair of upper facets joined to the pair of lower facets at a zig-zag generally horizontal segment fold line;

the horizontal segment fold line intersecting the vertical segment fold lines and forming said apex therewith, said apex being the upwardmost point of said horizontal segment fold line;

the horizontal segment fold line lying along a portion of a second nominal circumference, the second circumference being greater than the first nominal circumference; said vertical segment fold lines lying in vertical planes containing the longitudinal axis and connected to each other at the pyramidal segment apex; the upper facets having greater lengths int eh longitudinal axis plane than the lower facets;

said zig-zag generally horizontal ring fold lines intersecting said vertical segment fold lines at points, said points project upwardly and become the upwardmost points of said horizontal ring fold lines;

wherein, under sufficient vertical force, the lower facets fold under the nest beneath the upper facets, to vertically collapse the sidewall.

2. The container of claim 1 characterized by said top having an open neck, the circumference of the neck being less than said first nominal circumference.

3. The container of claim 1 characterized by the top and bottom being open.

4. The container of claim 1 characterized by the top and bottom being closed.

5. The container of claim 1 made of plastic.

6. The container of claim 1 wherein each ring has 12 segments, each segment lying along a 30 degree arc section of the first nominal circumference.

* * * * *